US005447315A

United States Patent [19]

Perkins

[11] Patent Number: 5,447,315

[45] Date of Patent: Sep. 5, 1995

[54] METHOD AND APPARATUS FOR SENSING SPEED AND POSITION OF PROJECTILE STRIKING A TARGET

[76] Inventor: John D. Perkins, 305 Sherwood Ave., Cary, Ill. 60013

[21] Appl. No.: 208,537

[22] Filed: Mar. 9, 1994

[51] Int. Cl.[6] ..... G06F 15/20

[52] U.S. Cl. ..... 273/371; 273/372; 273/181 R; 273/26 A; 273/348

[58] Field of Search ..... 273/371, 372, 26 A, 273/176 B, 181 R, 181 C, 181 G, 348

[56] References Cited

U.S. PATENT DOCUMENTS

| | | | |
|---|---|---|---|
| 2,784,000 | 3/1957 | Simjian | 273/181 C |
| 3,643,959 | 2/1972 | Cornell et al. | 273/185 R X |
| 3,778,059 | 12/1973 | Rorbaugh | 273/372 |
| 4,303,853 | 12/1981 | Thalmann | 273/372 |
| 5,062,641 | 11/1991 | Poillon et al. | 273/181 C |
| 5,095,433 | 3/1992 | Botarelli et al. | 364/423 |
| 5,303,924 | 4/1994 | Kluttz et al. | 273/185 R |

FOREIGN PATENT DOCUMENTS

| | | | |
|---|---|---|---|
| 0323941 | 7/1989 | European Pat. Off. | 273/372 |
| 1456832 | 11/1976 | United Kingdom | 273/181 C |
| 8603284 | 6/1986 | WIPO | 273/372 |

*Primary Examiner*—Vincent Millin
*Assistant Examiner*—Kerry Owens
*Attorney, Agent, or Firm*—Albert C. Smith

[57] ABSTRACT

A method and apparatus is disclosed for sensing the position and speed (force) of a projectile striking a target of arbitrary size and shape. The strike produces an acoustic shock wave which travels outward from the point of impact, striking several acoustic sensors at the periphery of the target. The resulting sensor's electrical waveforms are then analyzed to determine the position (from waveform timing) and speed (from waveform amplitude) of the projectile strike.

12 Claims, 2 Drawing Sheets

METHOD AND APPARATUS FOR SENSING SPEED AND POSITION OF PROJECTILE STRIKING A TARGET

FIELD OF THE INVENTION

This invention relates to systems for measuring the speed and position of a projectile striking a target, and in particular to systems for determining a player's performance in sports such as baseball, golf, etc.

BACKGROUND OF THE INVENTION

Various means have been explored to detect speed and/or position of a projectile, each with their own limitations and idiosyncrasies, For example, one system uses overlapping liquid filled tubes which selectively operate bellows and ultimately switch closures, in response to a pair of tubes being struck by a projectile such as a golf ball (see, for example, U.S. Pat. Nos. 2,783,999; 2,784,001; 2,894,752). Simjian also discloses an XY matrix of wires which contact a third orthogonal set of wires used to sense the pressure point of the projectile on the matrix. Target size and accuracy of these methods is directly proportional to the number of tubes, blocks, or wires provided (cost) and no measurement of speed is offered. Garcia (U.S. Pat. No. 4,199,141) describes the use of a matrix of resilient target blocks with switches instead of overlapping tubes with switches. Hand and Walker (U.S. Pat. No. 4,563,005) disclose a system of corner-mounted infrared sensors and an array of sequencing infrared emitters. A projectile interferes with the sensors view of the emitters, which emitter isn't seen indicating the position of the projectile. Tompkins et al, and Bear (U.S. Pat. No. 3,229,975) both disclose systems with an XY matrix of emitters and sensors where the projectile breaks a pair of emitter beams to indicate position, with beam break time indicating speed. Gaudet (U.S. Pat. No. 3,157,399) discloses an XY matrix using trip wires and switches. Again, target size and accuracy of this method is directly proportional to the number of emitters and sensors or trip wires provided (cost) and no measurement of speed is offered. Cornell, Schankier, and Kenrick (U.S. Pat. No. 3,643,959) disclose a mechanical means by which a projectile's position striking a target may be directly observed by a player, including an indication of projectile spin, although no measuring means is described. A means is also provided for measuring projectile speed by determining the time the projectile travels to the target. However, the means described requires that the projectile's start of travel produce a noise which can serve as a start-of-travel time marker, making this method suitable for hitting activities and substantially unsuitable for throwing activities. Finally, Poitras (U.S. Pat. No. 4,830,369) discloses a system in which the target has specific panels or sensitive areas of virtually any size and shape, each area when struck by a projectile making contact closure to report said strike. Other variations on this design use piezo-electric panels or areas to detect the projectile strike and some claim that the amplitude of the output of the piezo-electric sensing material gives an indication of strike force. However, as the strike position moves toward the edge of an area, a significantly smaller amplitude for the same force results making this method unreliable. Also, the more unique areas to be sensed, the more individual sensors are required, raising the cost.

SUMMARY OF THE INVENTION

It is the object of the present invention to provide a cost effective method of making large scale, highly accurate and reliable sensors of a target-striking projectile's position, spin, and speed, substantially overcoming the disadvantages of the prior art.

It is a feature of the present invention to provide a high resolution sensing panel whose complexity of operation does not increase with size. This is accomplished by sensing the timing differences in the acoustic waves which leave the impact site and travel to acoustic sensors at the edges of the panel.

Another feature of the present invention is measurement of the projectile's spin. This is accomplished by sensing the horizontal position and time difference of the projectile as it drops after striking the main sensing panel. As a spinning projectile will crawl along the surface of the sensor panel after impact, the horizontal position change after drop indicates the left or right spin component of the projectile, while the change in the drop time indicates the top or bottom spin component. Calculations for spin are based on the projectile's point of impact.

Another feature of the present invention is measurement of the projectile's speed. This is accomplished by determining the force of the shock wave produced by the projectile's impact, as measured at the acoustic sensors. Calculations for force are based on the projectile's point of impact. Speed is then a function of the calculated force and the mass of the projectile.

DESCRIPTION OF PREFERRED EMBODIMENTS

Figure 1:
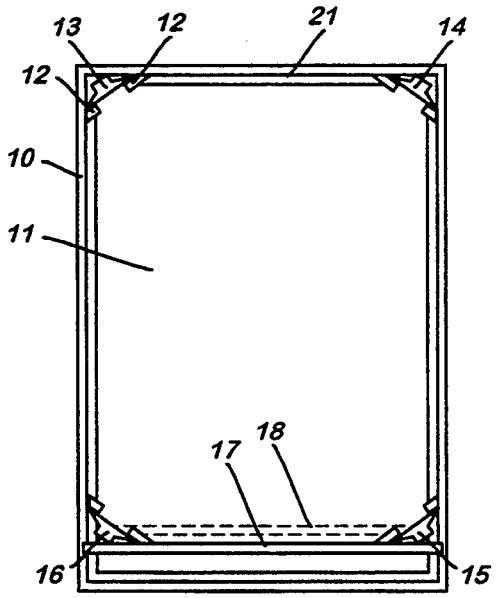
FIG. 1 presents a back view of a typical embodiment of the present invention as it may be incorporated in a sports amusement game.

Referring now to FIG. 1, the preferred embodiment of the present invention is built around a sound box frame 10. FIG. 1 shows a rear view of the sound box frame with the back removed. In the front is suspended the sensor panel 11. In the preferred embodiment, the sound box 10 is made of wood of suitable size for the application, by any standard means known to the cabinetry trade. Corner braces 12 are used for stability and to provide a housing for four acoustic sensors 13, 14, 15 and 16.

A shelf 17 placed in the frame below sensors 15 and 16 allow the sensor panel 11 to extend below the sensors 15 and 16 to allow for operation of the catch panel 38 which is described later. In the preferred embodiment, the catch panel 38 is attached to the sensor panel 11 along a seam 18 just above the shelf 17 in the sound box 10. The entire inside of the sound box 10, including the back (not shown) is lined with sound deadening 21 foam or other suitable sound absorbing material.

Figure 2:
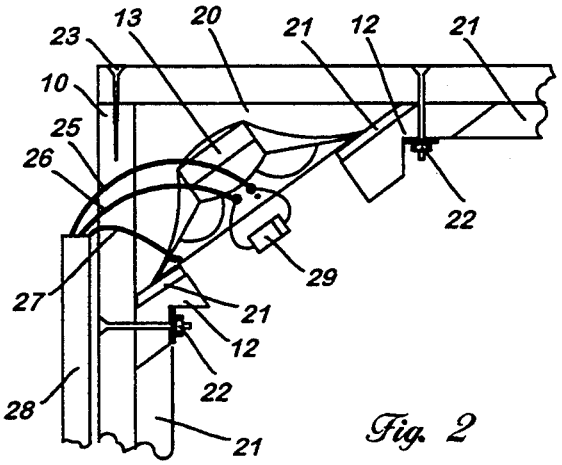
FIG. 2 shows the backview cutaway detail of the upper right corner of FIG. 1.

Referring now to FIG. 2, the detail shown is for the upper right corner (as viewed from the front) of the sensor. This detail may be rotated 90 degrees clockwise in succession to illustrate the detail of the upper left, lower left, and lower right corners.

In the preferred embodiment, the sound box 10 is made up of four pieces of ¾" plywood, about 10 inches wide and of proper length to form the frame of the sound box, and attached at the corners with wood screws 23. The back (not shown) is also ¾" plywood, attached to the four piece frame 10 in a similar manner.

In each corner is mounted and acoustic sensor as shown in FIG. 2. In the preferred embodiment, the acoustic sensor is a 8-inch soft-cone loudspeaker 13 with 10 ounce magnet and a 45 ohm voice-coil. The loudspeaker is nestled into sound absorbing foam 20, 21 to insulate it from vibrations in the sound box. The corner brace 12 holds that assembly in place with machine screws and nuts 22 such that the loudspeaker itself need not be attached with any other fasteners.

Signals induced in the acoustic sensor 13 are conducted out of the sound box by means of a two-conductor shielded cable 28. The shield wire 27 is attached to the acoustic sensor frame, to provide electrical noise shielding. The positive wire 25 is connected to the positive terminal of the acoustic sensor and the return wire 26 is connected to the negative terminal of the acoustic sensor.

A diode 29 across the acoustic sensor terminals (cathode to the positive side) provides electrical damping, preventing an excited acoustic sensor from oscillating after the shock wave has passed. Note that this diode may also be in the interfacing circuitry, but is shown at the acoustic sensor here for purposes of functional illustration.

Figure 3:
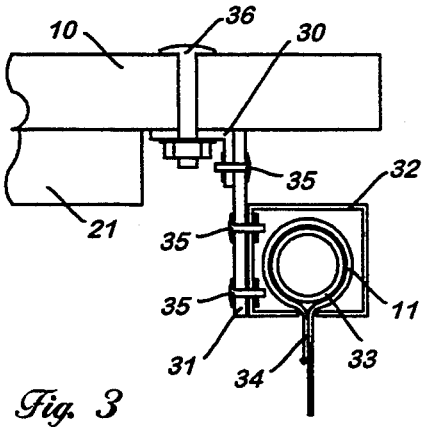
FIG. 3 illustrates the preferred method of attaching the sensor panel to the cabinet.

FIG. 3 shows a method of mounting the sensor panel 11 to the sound box 10. In the preferred embodiment, the sensor panel, suitable for detecting a projectile such a thrown or batted ordinary hard baseball, is made of 0.063 inch soft-hand vinyl. Such vinyl has the somewhat unique property of extruding to the shape of the baseball and in so doing, removes virtually all of the forward energy in the baseball, producing a very satisfactory shock wave. With its forward energy gone, the baseball then drops by force of gravity along the surface of the sensor panel.

As shown in FIG. 3, the vinyl sensor panel 10 is wrapped around tubing 33 made of stiff aluminum or steel, and bonded back to itself 34 with vinyl glue or ultrasonic welding. This assembly is then slid lengthwise into a slot in 1-inch square aluminum or steel tubing 32. This square tubing 32 fastens all four sides of the sensor panel in this same manner. The corners of the square tubing 32 then are fastened to each other at the corners by conventional corner framing means such as machine screwed to aluminum or steel corner blocks.

Attached to the square tubing sensor panel frame 32 by poprivets 35 is a number of ⅛th inch hard red rubber straps 31, positioned at approximately 12-inch intervals. The other end of these straps are attached to angle brackets 30 also with poprivets 35. The angle brackets are then attached to the sound box 10 with carriage bolts 36. It is important that the sound box design allow for the back to be removed to provide access to these brackets, as well as the acoustic sensors, and their wiring.

Figure 4:
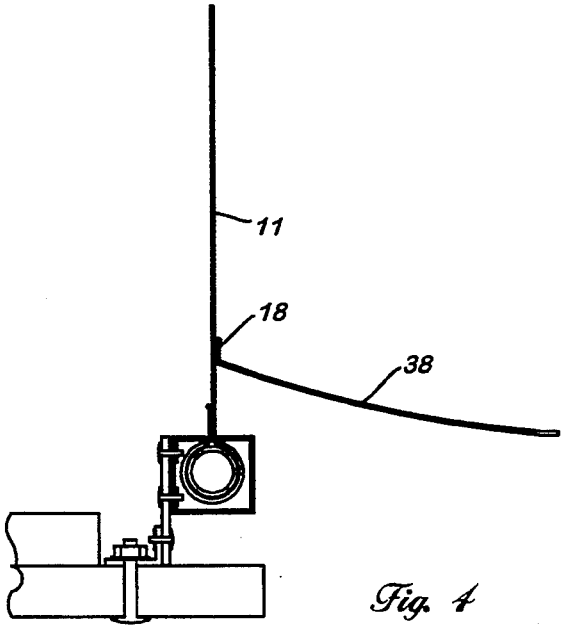
FIG. 4 shows the preferred method of attaching the catch panel to the sensor panel.

FIG. 4 shows the attachment of the catch panel 38 to the sensor panel 11 along the seam 18. In the preferred embodiment, the catch panel 38 is made of 0.031 inch soft-hand vinyl and is attached along seam 18 using vinyl glue or ultrasonic welding. The free end of the catch panel is anchored to any stationary surface such as a return pan, allowing projectiles striking the sensor panel and dropping into the catch pan, to then roll out and be returned as new projectiles.

Figure 7:
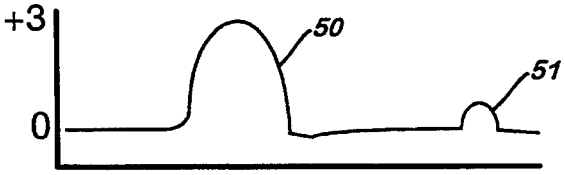
FIG. 7 shows a typical waveform which may be expected from each of the corner acoustic sensors.

The position of the seam 18 is important and is at a point vertically, half way through the lower loudspeakers acoustic sensors 15,16. When the projectile strikes the sensor panel, the resultant shock wave travels to the loudspeakers where positive pressure on the inside moves their cones inward to create a positive signal in the output cables. The polarity of the diode 29 allows this action to happen. A moment later, when the projectile drops onto the catch panel, that panel flinches, causing the attached sensor panel to jerk outward. This action, because of its position 18, creates a negative pressure behind the cones of the lower two loudspeakers, again causing their cones to move inward, creating a positive signal at the output cable. FIG. 7 shows an oscilloscope trace of the output of an acoustic sensor when the sensor panel is struck by a projectile. The initial inward motion of the loudspeaker cone creates the positive waveform 50. This waveform would continue below the zero level as the cone returns in an outward motion, except for the action of diode 29 which reflects the negative electrical energy back to the loudspeaker to provide a countermanding inward force. The net result is a damping of cone oscillations and the single pulse waveform shown. The second smaller waveform 51 is indicative of reflected sound reaching the acoustic sensor's cone after bouncing off of the opposite wall of the sound box. This signal may be identified by its relatively low amplitude and proximity to the larger initial waveform 50, and subsequently filtered out by the interfacing circuitry.

Figure 5:
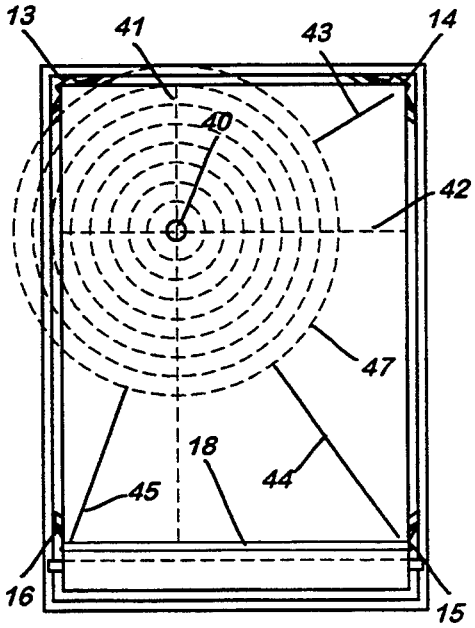
FIG. 5 illustrates the effect of a projectile striking the sensor panel.

Referring now to FIG. 5, when a projectile 40 strikes the sensor panel at X position 41 and Y position 42, a shock wave 47 is created in the sound box. That shock wave travels outward in a circular pattern at the speed of sound, reaching a first acoustic sensor (13 in this example) at some point in time. It continues outward until it reaches each of the remaining acoustic sensors 14, 16, and 15. In the example diagram of FIG. 5, timeline 43 is the difference in time between the shock wave reaching acoustic sensor 13 and acoustic sensor 14. Likewise, time-line 44 and 45 are the difference in time between the shock wave reaching acoustic sensor 13 and acoustic sensor 14 and 15 respectively.

Figure 8:
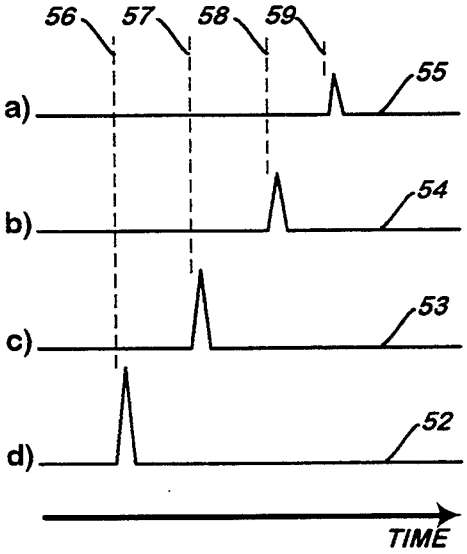
FIG. 8 illustrates typical waveforms of all four corner acoustic sensors in context.

FIG. 8 shows the acoustic sensor signal timing for the example in FIG. 5. Timeline 52 represents the output of acoustic sensor 13, timeline 53 represents the output of acoustic sensor 14, timeline 54 represents the output of acoustic sensor 16, and timeline 55 represents the output of acoustic sensor 15. Times 56, 57, 58 and 59 represent the absolute times at which the shock wave reaches acoustic sensors 13, 14, 16, and 15 respectively. The time difference between time 56 and time 57, therefore is equivalent to timeline 43 in FIG. 5. Similarly, the time difference between time 56 and time 58, is equivalent to timeline 45 and the time difference between time 56 and time 59, is equivalent to timeline 44, The values of these three time differences taken as a set, uniquely identifies the original impact position.

Interfacing circuitry may measure these timing differences in the output signals to compute the projectile's position by any of a number of well known means. For example, the three time differences may be used as arguments or indices into a table which directly reads out Cartesian coordinates. An alternative method suitable for large sensor panel areas is the solution to simultaneous linear equations with three unknowns, again by well understood mathematical means. A third method suitable for systems with limited storage and compute power is to iterate a close approximation using simple plane geometry.

Interfacing circuitry may also measure the amplitude of the four acoustic sensor signals and, knowing the impact point 41, 42, can calculate the strength of the impact. Each acoustic sensor's output could be compensated for (divided by the square of) the distance from the impact point to that acoustic sensor. Then, summing the results from all four yields an energy level, to subsequently be divided by the projectile's mass and multiplied by a calibration constant to provide miles-per-hour or any other appropriate speed measure.

Figure 6:
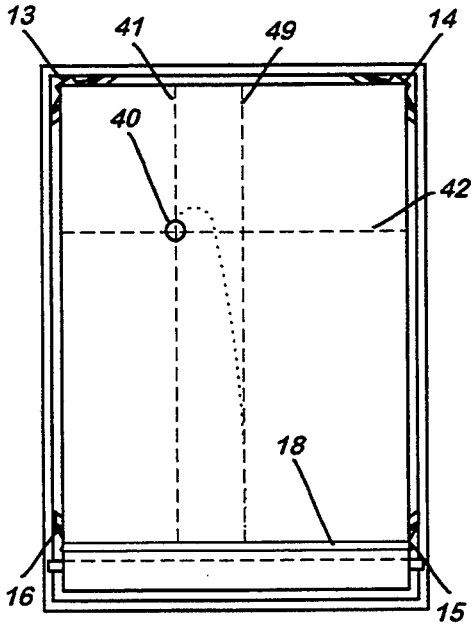
FIG. 6 shows the effect of a spinning projectile striking the sensor panel and then landing on the catch panel.

FIG. 6 illustrates the effects of top-right spin on a projectile which strikes the sensor panel at XY position 41, 42. The vinyl removes the forward motion energy from the projectile but not the spin motion. Instead, the spin motion results in the projectile's crawling along the surface of the sensor panel in the direction of the spin. This results in two measurable products which appear when the projectile finally drops onto the catch panel 38.

Figure 9:
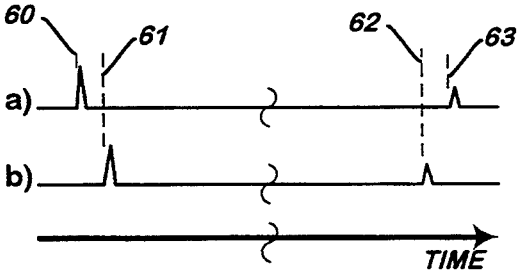
FIG. 9 illustrates typical waveforms of the two lower acoustic sensors at the time of projectile impact and later when the projectile drops into the catch panel.

First, the left/right spin causes the projectile to drop on the catch panel at a different X coordinate 49 from its original X coordinate 41. The resulting acoustic sensor output is shown in FIG. 9. It may be seen that the original shock wave reached acoustic sensor 16 (60) ahead of acoustic sensor 15 (61), yet when the projectile finally dropped sometime later, the drop shock wave reached sensor 15 (62) ahead of sensor 16 (63). The magnitude of this difference is a reflection of the amount of left/right spin on the projectile.

Top or bottom spin causes the projectile to crawl up or down the sensor panel before dropping onto the catch panel. This results in a measurable time delay between the anticipated drop time, given the original impact position and a simple gravity calculation, and the actual measured drop time, i.e. the time between the original sensor panel shock wave and the later catch panel shock wave. The magnitude of this difference is a reflection of the amount of top/bottom spin on the projectile.

I claim:

1. The method for detecting the position and speed of a projectile of known mass striking a target, comprising the steps of:

converting the forward energy of the projectile into an acoustic shock wave;

measuring the timing and amplitude of said acoustic shock wave as the acoustic shock wave reaches a plurality of locations;

converting said timing measurements into a striking position value of the projectile;

converting said amplitude measurements and the known mass of the projectile into a speed value of the projectile: and coupling said position and speed values to external circuitry.

2. Apparatus for determining the position and speed of a projectile having a known mass striking a target comprising:

an impact absorber for converting the forward energy of the projectile into an acoustic shock wave;

a plurality of acoustic sensors having an input for receiving the acoustic shock wave and having an output for providing timing and amplitude electrical signals indicative of the timing and amplitude of the acoustic shock wave;

a first interface having an input coupled to the output of the plurality of acoustic sensors for receiving the timing electrical signal and having an output for providing, in response to the timing electrical signal, a position signal indicative of the striking position of the projectile on the impact absorber; and a second interface having an input coupled to the output of the plurality of acoustic sensors for receiving the amplitude electrical signal and having an output for providing, in response to the amplitude electrical signal, a speed signal indicative of the striking speed of the projectile.

3. The apparatus of claim 2 wherein the position signal corresponds to a previously recorded striking position in a list of previously recorded striking positions for such timing signals, and the amplitude signal corresponds to a previously recorded striking speed is a list of previously recorded striking speeds for such amplitude signals and for the mass of the projectile.

4. The apparatus of claim 3, wherein the position signal corresponds to an interpolation of previously recorded striking positions, and the speed signal corresponds to an interpolation of previously recorded striking speeds.

5. The apparatus of claim 3, wherein the position signal corresponds to a mathematical function of previously recorded striking positions, and the speed signal corresponds to a mathematical function of previously recorded striking speeds.

6. The apparatus of claim 2, wherein the acoustic sensors are damped.

7. Apparatus for determining the spin of a projectile striking a target comprising:

a first impact absorber for receiving the projectile at a first striking position and for converting the forward energy of the projectile into a first acoustic shock wave;

a first plurality of acoustic sensors adjacent the first impact absorber, each acoustic sensor having an input for receiving the first acoustic shock wave and having an output for providing a first timing signal in response to the first acoustic shock wave;

a first interface having an input coupled to the first plurality of acoustic sensors for receiving the first timing signals and having an output for providing, in response to the first timing signals, a first position signal indicative of the first striking position of the projectile;

a second impact absorber for receiving the falling projectile at a second striking position after said receiving by the first impact absorber and converting the falling energy of the projectile into a second acoustic shock wave;

a second plurality of acoustic sensors adjacent the second impact absorber, each acoustic sensor having an input for receiving the second acoustic shock wave and having an output for providing a second timing signal in response to the second acoustic shock wave;

a second interface having an input coupled to the second plurality of acoustic sensors for receiving the second timing signals and having an output for providing, in response to the second timing signals, a second position signal indicative of the second striking position of the projectile;

a third interface having a first input coupled to the output of the first interface for receiving the first positions signal, having a second input coupled to the output of the second interface for receiving the second position signal, and having an output for providing, in response to the difference between the first and second position signals, a left-right spin signal indicative of the left-right spin of the projectile; and a fourth interface having a first input coupled to the output of the first plurality of acoustic sensors for receiving the first timing signal, having a second input coupled to the output of the second plurality of acoustic sensors for receiving the second timing signal, having a third input coupled to the output of the first interface for receiving the first position signal, and having an output for providing, in response to the first position signal and the difference between the first and second timing signals, a top-bottom spin signal indicative of the top-bottom spin of the projectile.

8. The apparatus of claim 7 wherein the first position signal corresponds to a recorded striking position in a list of previously recorded striking positions for such timing signals, the second position signal corresponds to a previously recorded striking position in a list of previously recorded striking positions for such timing signals, the left-right spin signal corresponds to a previously recorded left-right spin in a list of previously recorded left-right spins for such differences, and the top-bottom spin signal corresponds to a previously recorded top-bottom spin in a list of previously recorded top-bottom spins for such position signals and such differences.

9. The apparatus of claim 8, wherein the position signal corresponds to an interpolation of previously recorded striking positions, the speed signal corresponds to an interpolation of previously recorded striking speeds, the left-right spin signal is an interpolation of previously recorded left-right spins, and the top-bottom spin signal is an interpolation of previously recorded top-bottom spin.

10. The apparatus of claim 8, wherein the position signal corresponds to a mathematical function of the previously recorded striking positions, the speed signal corresponds to a mathematical function of the previously recorded striking speeds, the left-right spin signal is a mathematical function of the previously recorded left-right spins, and the top-bottom spin signal is a mathematical function of the previously recorded top-bottom spin.

11. The apparatus of claim 7, wherein each acoustic sensor is damped.

12. The method for determining the spin of a projectile striking a target comprising the steps of:

converting the forward energy of the projectile into a first acoustic shock wave;

measuring the timing of the first acoustic shock wave as the wave reaches multiple locations;

converting the first timing measurements into a first striking position of the projectile;

converting the falling energy of the projectile after striking the target into a second acoustic shock wave;

measuring the timing of the second acoustic shock wave as the reaches multiple locations;

converting the second timing measurements into a second striking position of the projectile;

converting the difference between the first and second striking positions into a left-right spin value of the projectile; and converting the first striking position and the difference in time between the first and second acoustic shock waves as the waves reach multiple locations into a top-bottom spin value of the projectile.

* * * * *